US009149828B2

(12) United States Patent
Wang

(10) Patent No.: US 9,149,828 B2
(45) Date of Patent: Oct. 6, 2015

(54) CARBON FIBER SURFACE OIL CHANGING DEVICE

(71) Applicant: UHT UNITECH CO., LTD., Zhongli, Taoyuan County (TW)

(72) Inventor: Chih-Yung Wang, Taoyuan (TW)

(73) Assignee: UHT UNITECH CO., LTD., Zhongli, Taoyuan County (TW)

( * ) Notice: Subject to any disclaimer, the term of this patent is extended or adjusted under 35 U.S.C. 154(b) by 95 days.

(21) Appl. No.: 13/963,348

(22) Filed: Aug. 9, 2013

(65) Prior Publication Data

US 2015/0040823 A1 Feb. 12, 2015

(51) Int. Cl.

| | |
|---|---|
| ***B05C 9/10*** | (2006.01) |
| ***B05C 5/02*** | (2006.01) |
| ***B05C 3/12*** | (2006.01) |
| ***B05C 9/12*** | (2006.01) |
| ***B05C 9/14*** | (2006.01) |
| *D01F 11/14* | (2006.01) |

(52) U.S. Cl.

CPC ... *B05C 9/10* (2013.01); *B05C 3/12* (2013.01); *B05C 5/0245* (2013.01); *B05C 9/12* (2013.01); *B05C 9/14* (2013.01); *D01F 11/14* (2013.01)

(58) Field of Classification Search

CPC ..... B05D 1/38; B05D 1/36; B05D 3/0236; B05D 3/0272; B05D 3/0413; B05D 2256/00; B05C 9/06; B05C 9/10; B05C 9/12; B05C 9/14; B05C 3/005; B05C 3/125; D01F 11/14; D06M 15/00; D06M 15/19; D06M 15/37; D06M 23/00; D06M 2101/40; D06M 2200/40; Y10T 428/2913; Y10T 428/2918; Y10T 428/2933; Y10T 428/2964

USPC ..... 118/66–68, 72, 641–643; 427/177, 226, 427/227, 314, 334, 352, 371, 402, 407.1; 428/364, 367, 368, 375, 408

See application file for complete search history.

(56) References Cited

U.S. PATENT DOCUMENTS

| | | | | |
|---|---|---|---|---|
| 4,186,179 | A * | 1/1980 | Katsuki et al. | 423/447.4 |
| 5,230,956 | A * | 7/1993 | Cole et al. | 428/367 |
| 5,277,973 | A * | 1/1994 | Yamamura et al. | 428/367 |
| 5,776,383 | A * | 7/1998 | Darrieux et al. | 264/29.1 |

FOREIGN PATENT DOCUMENTS

| | | |
|---|---|---|
| JP | 57-015229 | 1/1982 |
| JP | 6256266 | 3/1987 |
| JP | 62276075 | 11/1987 |

(Continued)

*Primary Examiner* — Laura Edwards

(74) *Attorney, Agent, or Firm* — Jackson IPG PLLC; Demian K. Jackson

(57) ABSTRACT

A changing device includes a feed component, a winder, a desizing oven, a coating component and a sizing component, and the feed component is provided for supplying a carbon fiber material, and a thermosetting resin oil is covered onto a surface of the carbon fiber material, and a desizing oven is provided for removing the thermosetting resin oil form the surface of the carbon fiber material, and then the coating component coats a surfactant onto the surface of the carbon fiber material, and finally the sizing component is used to coat a thermoplastic resin oil onto a surface of the surfactant to form a carbon fiber product to be wound onto a rewinding part of the winder, so as to produce a carbon fiber product with a thermoplastic resin oil coated onto a surface of the carbon fiber product.

6 Claims, 5 Drawing Sheets

(56) References Cited

FOREIGN PATENT DOCUMENTS

| | | |
|---|---|---|
| JP | 6-385167 | 4/1988 |
| JP | 01-272867 | 10/1989 |
| JP | 02-169763 | 6/1990 |
| JP | 02-210059 | 8/1990 |
| JP | 04-008542 | 1/1992 |
| JP | 04-044016 | 2/1992 |
| JP | 04-361619 | 12/1992 |

* cited by examiner

CARBON FIBER SURFACE OIL CHANGING DEVICE

FIELD OF THE INVENTION

The present invention relates to a changing device, in particular to a carbon fiber surface oil changing device.

BACKGROUND OF THE INVENTION

In general, carbon fiber is used in composite enhanced substances with different types of substrates, and the adhesiveness of a specific substrate is important to carbon the fiber to show the characteristics of the enhanced substances.

Non-surface treatment carbon fibers usually have insufficient adhesiveness for the substrate and poor transverse properties such as the separating strength and shear strength. Naturally, the carbon fiber generally receives an oxidization treatment such as an electrolytic oxidation treatment, a gas-phase chemical oxidation treatment or a liquid-phase chemical oxidation treatment after a carbonization or graphitization takes place, and oxygen-containing functional groups are added into the carbon fiber to improve the wettability of the substrates.

With regard to the surface characteristics of the carbon fiber after being processed by the oxidization treatment, Japan Patent Publication 4-361619 disclosed a method of improving the adhesive strength of the carbon fiber to the substrate by depositing a specific functional group onto the uppermost surface of the carbon fiber. This patent also specifies the carbon fiber whose surface oxygen concentration and surface nitrogen concentration are both measured by X-ray optoelectronic spectroscopy measurement techniques (such as those disclosed in Japan Examined Patent Publication No. 4-44016, and Japan Unexamined Patent Application Publication Nos. 2-210059, 2-169763, 63-85167, and 62-276075), but these inventions do not include the study of a combination of a sizing agent. In addition, these patents are simply described by using the surface functional groups such as the drawback of having a poor adhesion with a substrate, particularly the substrate with a low reactivity.

On the other hand, carbon fiber and graphite fiber are peculiarly hard and brittle and lack of adhesiveness, bending strength and wear-resistance, so that various different types of sizing agents are generally added into the treated carbon fiber to prevent the formation of fine hair and the occurrence of thread fracture, so as to improve the adhesiveness, bending strength and wear-resistance. Studies on developing and using a sizing agent such as a paste or an adhesive to improve the treatment are conducted, but the study on the improvement of adhesiveness of the sizing agent to a substrate has not been actually performed. In addition, the study on modifying surface characteristics by a sizing agent has not been performed. For example, the functional groups on the aforementioned carbon fiber surface are used to improve the overall characteristics including adhesiveness and tension of a composite.

Since the most popular substrate used in a carbon fiber enhancing composite substance is epoxy resin, and the sizing agent is usually epoxy resin or modified epoxy resin which are biphenol A diglycidyl ether type epoxy resins such as aromatic compounds with a structure related to the substrate (as disclosed in Japan Examined Patent Publication No. 4-8542, Japan Unexamined Patent Application Publication No. 1-272867, and Japan Examined Patent Publication Nos. 62-56266 and 57-15229). However, the aforementioned common sizing agent is a thermosetting resin, so that if it is necessary to produce a thermoplastic carbon fiber composite material, then the interface will not be matched, and the carbon fiber and the resin will be unable to form a complete joint interface, and the sizing agent cannot be used extensively for electric/electronic components, mechanical components or automobile components which are manufactured by injection molding. Therefore, it is an urgent and important subject for related manufacturers to develop a changing device capable of changing the carbon fiber surface oil.

SUMMARY OF THE INVENTION

In view of the aforementioned problems of the conventional oil changer, it is a primary objective of the present invention to provide a changing device capable of changing a carbon fiber surface oil in order to overcome the drawbacks of the prior art.

To achieve the aforementioned objective, the present invention provides a changing device comprising a feed component, a winder, a desizing oven, a coating component and a sizing component, and the feed component is provided for supplying a carbon fiber material, and a thermosetting resin oil is covered onto a surface of the carbon fiber material, and a desizing oven is provided for removing the thermosetting resin oil form the surface of the carbon fiber material, and then the coating component coats a surfactant onto the surface of the carbon fiber material, and finally the sizing component is used to coat a thermoplastic resin oil onto a surface of the surfactant to form a carbon fiber product to be wound onto a rewinding part of the winder, so as to produce a carbon fiber product with a thermoplastic resin oil coated onto a surface of the carbon fiber product.

DESCRIPTION OF THE PREFERRED EMBODIMENTS

The present invention will become clearer in light of the following detailed description of an illustrative embodiment of this invention described in connection with the drawings. It is intended that the embodiments and drawings disclosed herein are to be considered illustrative rather than restrictive.

Figure 1:
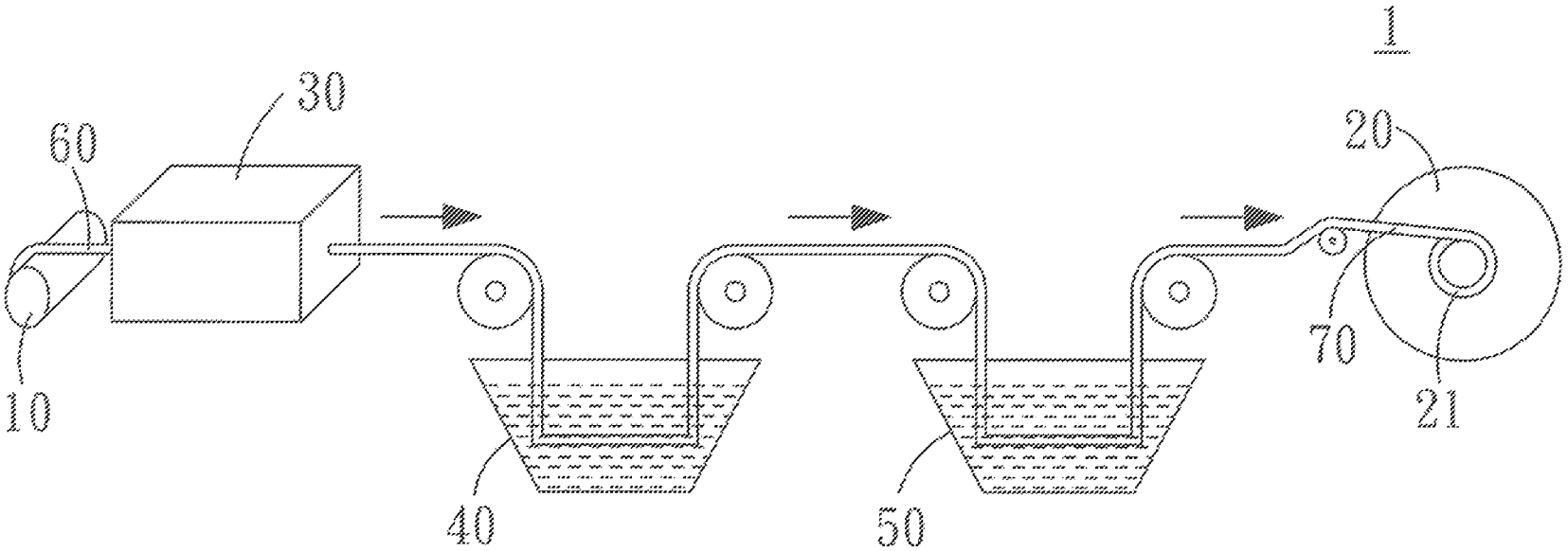
FIG. 1 is a schematic view of a changing device of the present invention.

With reference to FIG. 1 for a schematic view of a changing device of the present invention, the changing device 1 comprises a feed component 10, a winder 20, a desizing oven 30, a coating component 40 and a sizing component 50.

Figure 2:
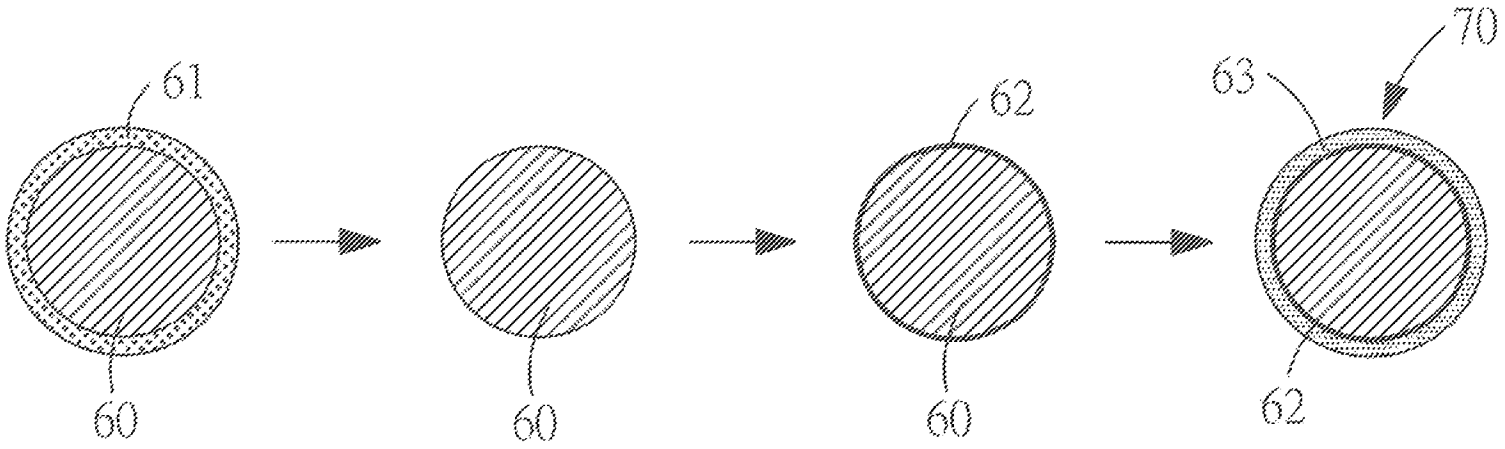
FIG. 2 is a schematic view of changing a carbon fiber surface of the present invention.

In FIG. 2, the feed component 10 is used for supplying a carbon fiber material 60, and a thermosetting resin oil 61 is covered onto a surface of the carbon fiber material 60, wherein the carbon fiber can be of any type or a different K number (standing for thousand of filaments per tow).

The winder 20 is installed behind the feed component 10 and includes at least one rewinding part 21, wherein an end of the carbon fiber material 60 is wound to the feed component 10, and the other end of the carbon fiber material 60 is manufactured to form a carbon fiber product 70 to be wound to the rewinding part 21.

The desizing oven 30 is installed between the feed component 10 and the winder 20 for removing the thermosetting resin oil from the surface of the carbon fiber material to produce a carbon fiber material 60 without any oil on the surface as shown at the position on the left of the center of FIG. 2, and the desizing oven 30 includes a heating component capable of heating up to a high temperature of 250~650° C. for 1~60 seconds for desizing, or the desizing oven includes a first reservoir provided to store an organic solvent (such as acetone or chloroform) for cleaning the surface of the carbon fiber material in order to remove the thermosetting resin oil from the surface of the carbon fiber material.

The coating component 40 is connected behind the desizing oven 30, and a surfactant 62 is covered onto the surface of the carbon fiber material 60, wherein the coating component sequentially includes second and third reservoirs (not shown in the figure), and the second reservoir is provided to store ethanol for cleaning the surface of the carbon fiber material, and the third reservoir is provided to store 0.5~1 wt % of amine-containing surfactant and 99~99.5 wt % of aqueous ethanol, and an aerosol spray method or a soaking method is adopted to coat the surfactant 62 onto the surface of the carbon fiber material 60, and the surfactant 62 facilitates applying the oil onto the surface of the carbon fiber material 60 again and forming a complete interface with the carbon fiber surface.

The sizing component 50 is connected behind the coating component 40, and a thermoplastic resin oil 63 is covered onto a surface of the surfactant 62 to form a carbon fiber product 70 to be wound onto a rewinding part 21 of the winder 20, wherein the sizing component 50 includes a fourth reservoir provided to store a thermoplastic resin oil which can be PU, PE, PP or acrylic oil and attached onto a surface of the surfactant 62 by a soaking method or an immersion method.

Figure 3:
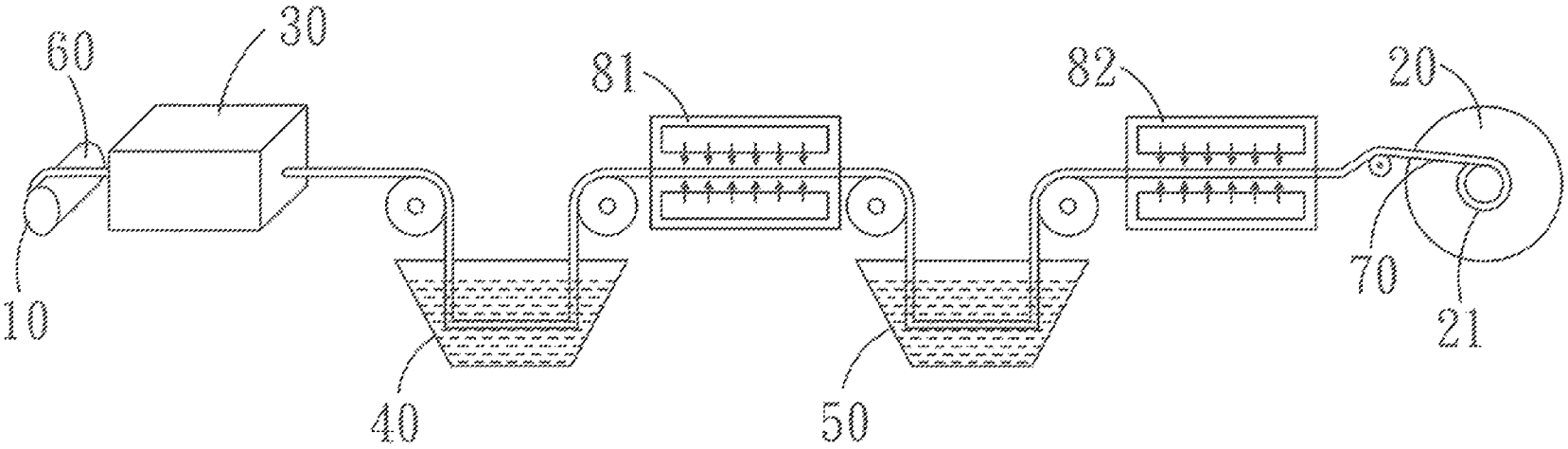
FIG. 3 is another schematic view of a changing device of the present invention.

In FIG. 3, a first drying component 81 is further installed between the coating component 40 and the sizing component 50, wherein the first drying component 81 is a hot air drying oven, and a second drying component 82 is further installed behind the sizing component 50.

It is noteworthy that the changing device of the present invention can change a carbon fiber surface oil, particularly can change the original thermosetting resin oil on the surface of the carbon fiber into a thermoplastic resin oil, so that when the carbon fiber is used for manufacturing a thermoplastic carbon fiber composite material, the carbon fiber and the resin can form a complete joint interface, and the carbon fiber can be applied extensively in various different types of electric/electronic components, mechanical components and automobile components manufactured by injection molding.

Figure 4:
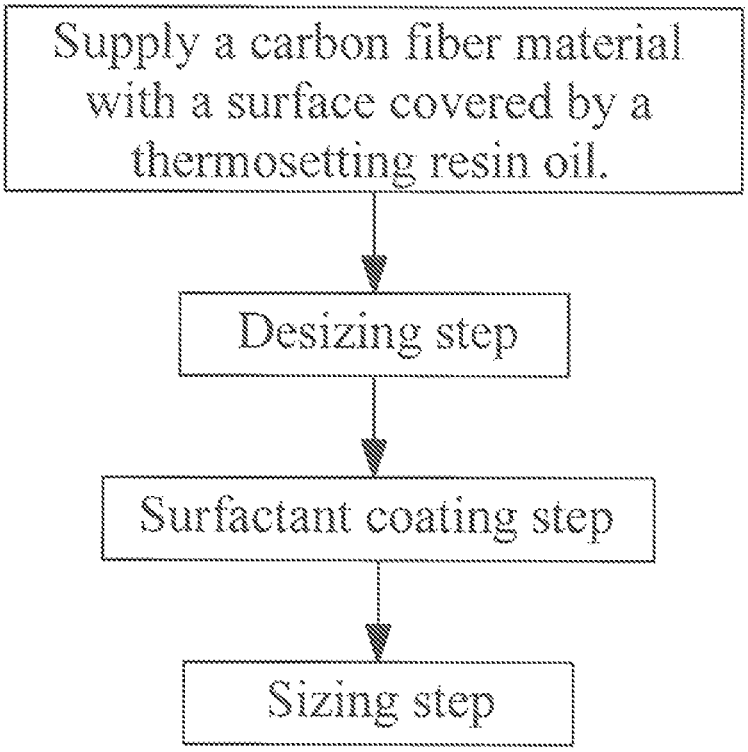
FIG. 4 is a flow chart of a changing method of the present invention.
Figure 5:
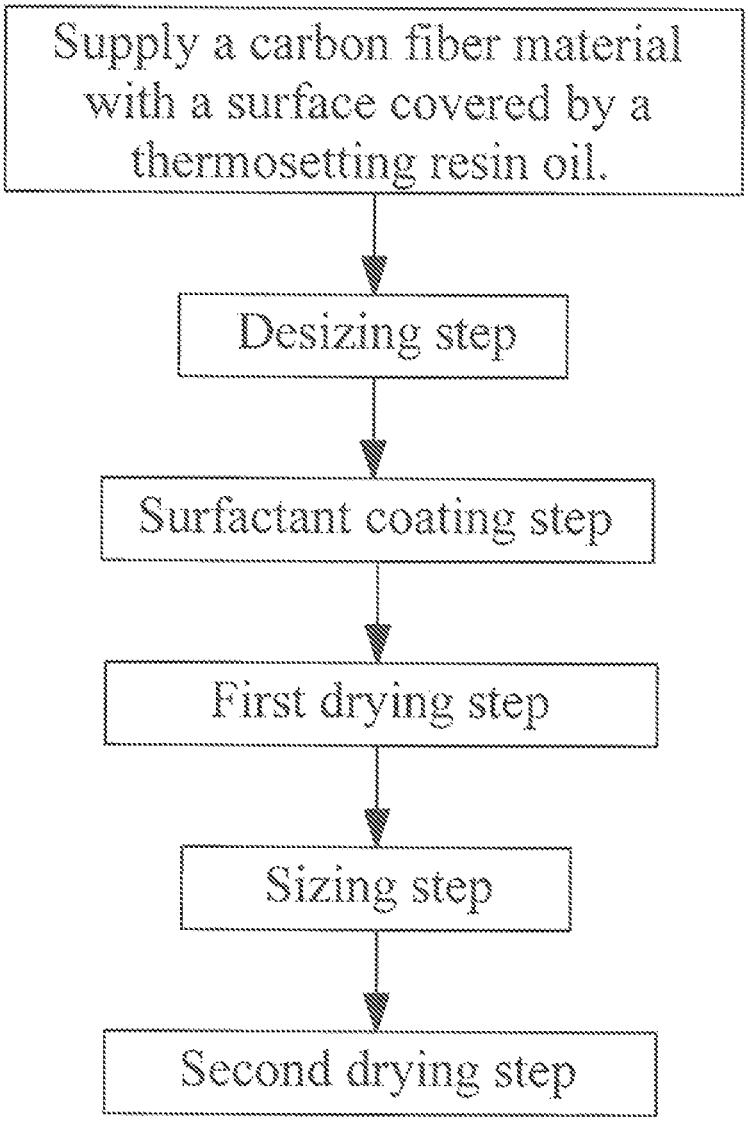
FIG. 5 is another flow chart of a changing method of the present invention.

With reference to FIG. 4 for a flow chart of a changing method used by the changing device of the present invention, and the changing method comprises the following steps:

Provide a carbon fiber material as shown in FIG. 2, wherein a thermosetting resin oil 61 is covered onto a surface of the carbon fiber material 60, and the carbon fiber can be of any type or a different K number, and the types of the carbon fiber include polyacrylonitrile (PAN), pitch, rayon or phenolic fiber, and the K number (thousands of filaments per tow) of the carbon fiber can be 1K, 3K, 6K, 12K, 24K, 48K, 50K or 60K.

Perform a desizing step to remove the thermosetting resin oil from the surface of the carbon fiber material to form a carbon fiber material 60 without any oil on the surface (as shown at the position on the left of the center of FIG. 2), wherein the desizing step is conducted at a high temperature of 250~650° C. for 1~60 seconds, or an organic solvent (such as acetone or chloroform) is used to clean the surface of the carbon fiber material in order to remove the thermosetting resin oil from the surface of the carbon fiber material 60.

Coat a surfactant, wherein the surfactant 61 is covered onto the surface of the carbon fiber material 60. In this step, ethanol is used for cleaning the surface of the carbon fiber material first, and then 0.5~1 wt % of amine-containing surfactant and 99~99.5 wt % of aqueous ethanol are used for coating the surface, and this method can be an aerosol spray method or a dipping method, such that the surfactant 62 is covered onto the surface of the carbon fiber material 60, and the surfactant 62 facilitates applying the oil onto the surface again and forming a complete interface with the carbon fiber surface.

Perform a sizing step, wherein a thermoplastic resin oil 63 is covered onto a surface of the surfactant 62. In this step, a soaking method or an immersion method can be used for attaching the thermoplastic resin oil 63 onto the surface of the surfactant 62, and the thermoplastic resin oil can be PU, PE, PP, acrylic or PC/ABS oil with a concentration of 0.1~5 wt % for sizing.

Of course, a first drying process can be added between the surfactant coating step and the sizing step, and a second drying process can be added after the sizing step takes place. In the first drying step, a hot air drying method can be used for drying at a temperature of 20~50° C. by air. Until the surfactant on the surface of the carbon fiber is shaped, the sizing step is performed. In the second drying process, a drying oven is used for drying, wherein the drying temperature is 120~300° C.

In summation of the description above, the present invention improves over the prior art, and is thus duly filed for patent application. While the invention has been described by means of specific embodiments, numerous modifications and variations could be made thereto by those skilled in the art without departing from the scope and spirit of the invention set forth in the claims.

What is claimed is:

1. A carbon fiber surface oil changing device, comprising:

a feed component supplying a carbon fiber material with a surface covered by a thermosetting resin oil;

a winder, installed behind the feed component, and having at least one rewinding part, and a first end of the carbon fiber material being wound onto the feed component, and the other end of the carbon fiber material being manufactured as a carbon fiber product is wound onto the rewinding part;

a desizing oven, installed between the feed component and the winder and including a first reservoir formed therein storing an organic solvent so as to clean the surface of the carbon fiber material so as to remove the thermosetting resin oil from the surface of the carbon fiber material;

a coating component, connected behind the desizing oven including second and third reservoirs formed sequentially thereon so as to respectively store and cover a cleaner and then a surfactant onto a surface of the carbon fiber material; and a sizing component, connected behind the coating component an including a fourth reservoir provided to store thermoplastic resin oil so as to cover the thermoplastic resin oil covered onto the surfactant to form a carbon fiber product coated with the thermoplastic resin oil wound onto the winder rewinding part.

2. The carbon fiber surface oil changing device of claim 1, wherein the desizing oven includes a heating component installed therein and heated up to a high temperature of 250° C.~650° C. for 1~60 seconds for desizing.

3. The carbon fiber surface oil changing device of claim 1, wherein the second reservoir stores ethanol for cleaning the surface of the carbon fiber material, and the third reservoir stores 0.5~1 wt % of amine-containing surfactant and 99~99.5 wt % of aqueous ethanol.

4. The carbon fiber surface oil changing device of claim 1, further comprising a first drying component installed between the coating component and the sizing component.

5. The carbon fiber surface oil changing device of claim 4, wherein the first drying component is a hot air drying oven.

6. The carbon fiber surface oil changing device of claim 1, further comprising a second drying component installed behind the sizing component.

* * * * *